US006471300B1

(12) United States Patent
Tomiyama

(10) Patent No.: US 6,471,300 B1
(45) Date of Patent: Oct. 29, 2002

(54) TOOTHBRUSH AND MANUFACTURING METHOD THEREOF

(76) Inventor: Hideo Tomiyama, 24-1-13, Nagaomotomachi 3-chome, Hirakata-shi, Osaka 573-0163 (JP)

( * ) Notice: Subject to any disclaimer, the term of this patent is extended or adjusted under 35 U.S.C. 154(b) by 0 days.

(21) Appl. No.: 09/719,034

(22) PCT Filed: Jun. 18, 1999

(86) PCT No.: PCT/JP99/03281

§ 371 (c)(1),
(2), (4) Date: Dec. 6, 2000

(87) PCT Pub. No.: WO99/66815

PCT Pub. Date: Dec. 29, 1999

(30) Foreign Application Priority Data

Jun. 22, 1998 (JP) ..... 10-174976

(51) Int. Cl.[7] ..... A46B 9/04; A46B 3/04; A46B 7/08; A46B 7/10

(52) U.S. Cl. ..... 300/21; 15/27

(58) Field of Search ..... 15/167.1, 23, 25, 15/27; 300/21

(56) References Cited

U.S. PATENT DOCUMENTS 805,733 A * 11/1905 Key
1,091,090 A * 3/1914 Tacail
1,569,431 A * 1/1926 Lucia
1,693,229 A * 11/1928 Felmar
1,758,632 A * 5/1930 Wagner
2,175,975 A * 10/1939 Steiner
2,220,053 A * 10/1940 Pruner
2,246,867 A * 6/1941 Thomas et al.
D166,427 S * 4/1952 Strock
4,317,463 A * 3/1982 Massetti
4,979,256 A * 12/1990 Branford
5,044,039 A * 9/1991 Picard
5,108,155 A * 4/1992 Hettes
D330,287 S * 10/1992 Wise

* cited by examiner

*Primary Examiner*—Terrence R. Till
(74) *Attorney, Agent, or Firm*—Vedder Price Kaufman & Kammholz

(57) ABSTRACT

A toothbrush effective for removing plaque deposited on peripheral surfaces of adjacent teeth and the inner parts of teeth and massaging gums, comprising a rotary brush (5) formed into a roller shape by extending many bristles (6) radially outwardly from the outer peripheral surface of an annular unit (5*a*) provided at the center thereof with a shaft hole (5*c*) and a block handle (1) having at one end (1*b*) thereof a support shaft (4) for rotatably supporting the rotary brush (5).

2 Claims, 8 Drawing Sheets

TOOTHBRUSH AND MANUFACTURING METHOD THEREOF

FIELD OF THE INVENTION

The present invention relates to a toothbrush effective for removing plaque deposited on teeth and massaging gums, and a method of making the same.

DESCRIPTION OF THE RELATED ART

Most popular toothbrushes basically comprise many bristles affixed on one end of a handle. In order to enhance the effect of removing plaque, many types of toothbrushes, in which configurations of bristles and handles are improved, are provided. It was difficult for users to make bristles reach the inner parts of teeth, because these types of toothbrushes are designed to brush teeth right and left or up and down with bristle tips along teeth. The types therefore cannot completely remove plaque deposited on peripheral surfaces of adjacent teeth and their inner parts. Simply upright bristle tips cannot stimulate gums sufficiently and may possibly cause pyorrhea alveolaris.

In order to solve the above problem, a primary object of the present invention is to provide a toothbrush which effectively removes plaque deposited on peripheral surfaces of adjacent teeth and their inner parts, and massages gums.

SUMMARY OF THE INVENTION

To achieve the above objects, a toothbrush comprises a rotary brush formed into a roller shaped by extending many bristles radially outwardly from the outer peripheral surface of an annular unit provided with a shaft hole at the center thereof and a block handle having at one end thereof a support shaft for rotatably supporting the rotary brush.

The toothbrush further comprises said support shaft being supported between a right extension and a left one projecting bifurcately from both sides of one surface of said block handle on which said rotary brush is disposed.

The toothbrush also comprises said block handle having small through holes from one surface on which said rotary brush is disposed to the opposite side.

A method of manufacturing a toothbrush comprises a rotary brush, and a handle, wherein the rotary brush is formed into a roller shape by extending many bristles radially outwardly from the outer peripheral surface of an annular unit provided with a shaft hole at the center thereof, and is supported by a support shaft disposed in one end portion of the said handle, having the steps of bundling many bristles made of nylon, heating and melting one end of a bundle of bristles into a deposited portion, curving the bundle of bristles into an approximately arc shape and connecting such arc shaped bundles.

As described in the foregoing, the present invention is a toothbrush comprising a rotary brush formed into a roller shape by binding many bristles and rotatably supported by a support shaft disposed in one end portion of a block handle. Grasp the other end of the block handle and then rotate the rotary brush along teeth and gums in the mouth, and bristle tips get in between teeth. This results in removing plaque deposited on teeth or food partials effectively and in massaging gums, which brings the effect of prevention or cure of tooth decay or periodontal diseases such as pyorrhea alveolaris.

DETAILED DESCRIPTION OF THE PREFERRED EMBODIMENTS

Figure 1:
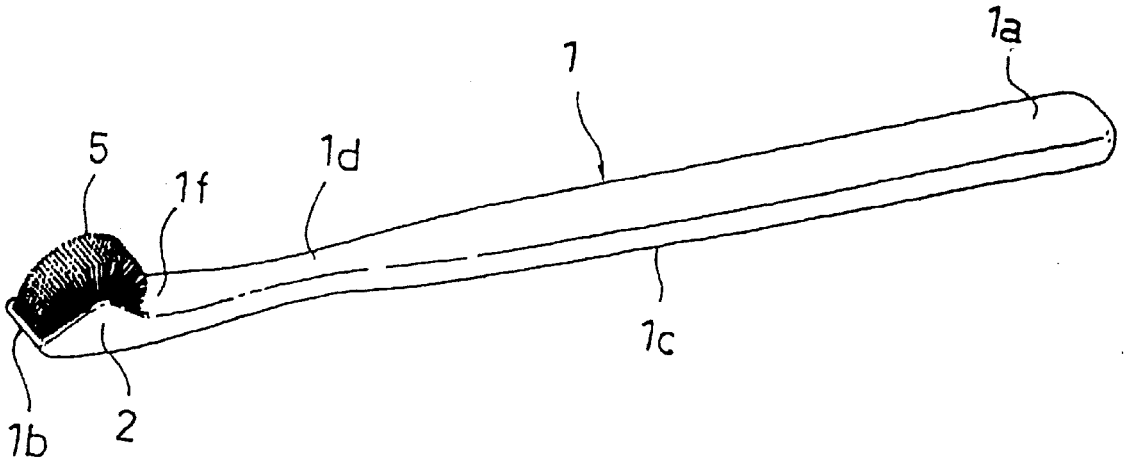
FIG. 1 is a perspective view of a toothbrush according to the present invention.
Figure 2:
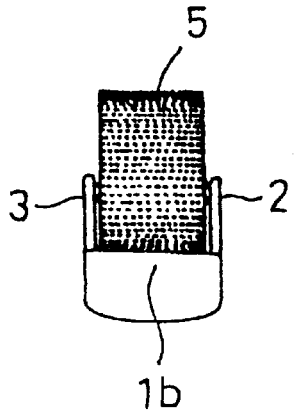
FIG. 2 is a front view of the present toothbrush.
Figure 3:
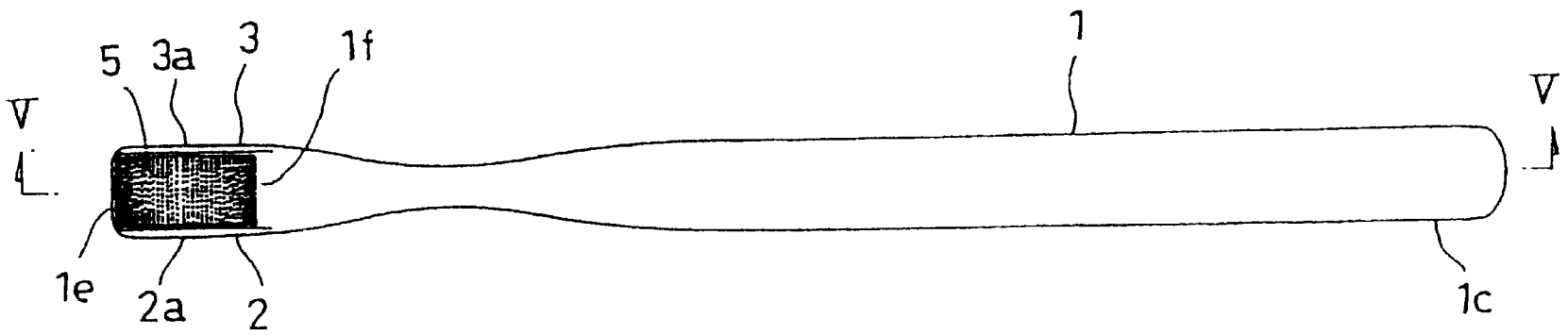
FIG. 3 is a plan view of the present toothbrush.
Figure 4:
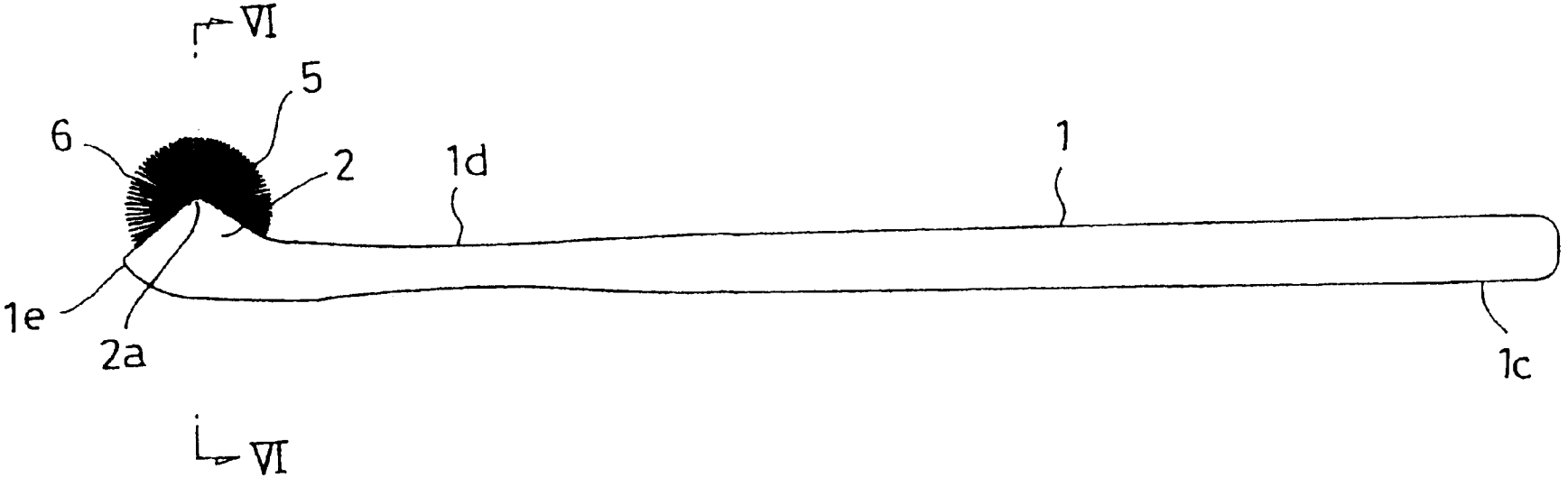
FIG. 4 is a side view of the present toothbrush.
Figure 5:
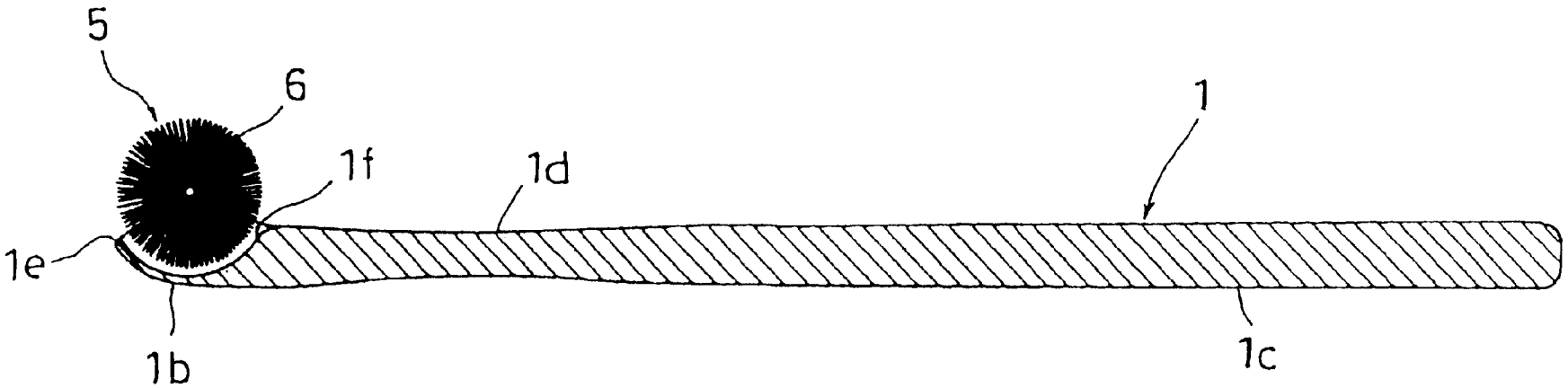
FIG. 5 is a vertical sectional view taken along a line V—V of FIG. 3.
Figure 6:
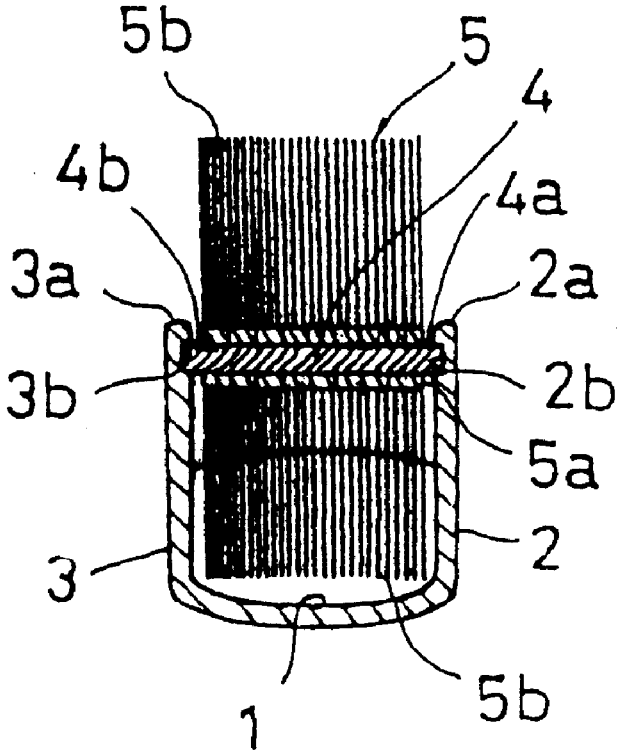
FIG. 6 is a cross sectional view taken along a line VI—VI of FIG. 4.

Referring to drawings, embodiments of the invention are described as follows:

FIG. 1 is a perspective view of a toothbrush according to the present invention;

FIG. 2 is a front view of the present toothbrush;

FIG. 3 is a plan view of the present toothbrush;

FIG. 4 is a side view of the present toothbrush;

FIG. 5 is a vertical sectional view taken along a line V—V of FIG. 3;

FIG. 6 is a cross sectional view taken along a line VI—VI of FIG. 4.

The present toothbrush is designed to brush teeth by putting it in the mouth and rotating it. The toothbrush comprises a rotary brush 5 which is rotatably supported in a front end portion of a block handle 1. The handle 1 is made of bamboo or a synthetic resin such as plastics. The handle 1 has a rear end portion 1*a* as a grip, and a front end portion 1*b*, on which extensions 2, 3 are formed.

These extensions 2, 3 are formed bifurcately in order to dispose the rotary brush 5. Each extension is projected in approximately triangle shape, from both sides of a concave 1*f* which is formed in a lower surface 1*d* of the front end portion 1*b*. Outer sides of the extensions 2, 3 are approximately flat from a curved tip 1*e* of the handle 1. Each extension 2, 3 also has a fitting groove 2*b*, 3*b* in an inner wall of an opposing top portion 2*a*, 3*a*, and the fitting groove 2*b*, 3*b* makes it possible for both ends 4*a*, 4*b* of a support shaft 4 to be fitted thereto.

The support shaft 4 rotatably supports the rotary brush 5 by inserting it into a shaft hole 7*a* formed in the center of the rotary brush 5 and fitting both ends 4*a*, 4*b* to the fitting grooves 2*b*, 3*b* (Ref. FIG. 6). The distance between the support shaft 4 and the concave 1*f* of the block handle 1 is such that bristle tips 5*b* are out of contact with the concave 1*f* with the rotary brush 5 in position.

The block handle 1 thus formed comprises the right extension 2 and the left extension 3 projecting bifurcately from the lower surface 1*d* in the approximately triangle shape, and outer sides of both extensions are flat. These features allow users to brush teeth without hurting the inside of their mouth.

The said rotary brush 5 is manufactured by binding many bristles 6 made of synthetic textile such as nylon. In order to manufacture many rotary brushes 5 efficiently, it is preferable to use some tools such as cutting tools, heating tools, pressure tools, attachment tools and so on.

Figure 7:
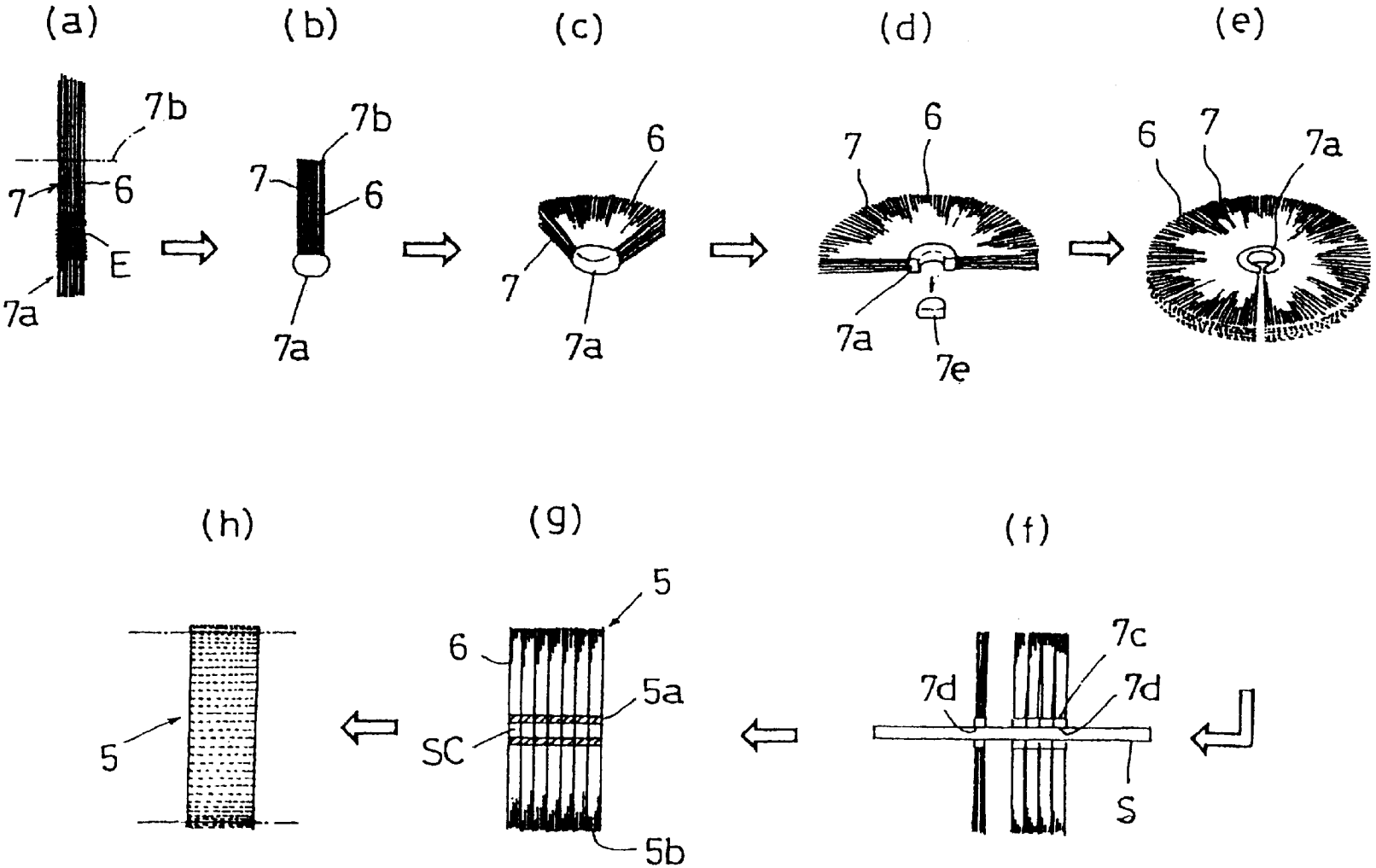
FIG. 7 is a drawing showing manufacturing steps of the rotary toothbrush; (a) shows a bundle of bristles, (b) the heating step of the bundle of bristles, (c) the initial step of pressurizing the bundle of bristles, (d) the step of pressurizing and spreading the bundle of bristles in fan shape, (e) the step of pressurizing and further spreading the bundle of bristle in approximately round shape, (f) the step of gluing and connecting the bundles of bristles to one another, (g) the cross configuration of the connected bundles and (h) the step of cutting evenly the periphery of a completed rotary brush.

Referring to FIG. 7, manufacturing steps of the rotary brush are described below. First, bind many bristles 6, and as illustrated in FIG. 7(*a*), wind a piece of enamel wire E on the bound bristles several times and bundle them into an assemblage 7. Then, heat one end 7*a* of the assemblage 7 with a heating tool and melt the end into semi-round shape as illustrated in FIG. 7(*b*) to keep them together. Then, cut the other end 7*b* of the assemblage 7 to a proper length and make all ends the same length.

Pressurize semi-round one end 7*a*, using a pressure tool. This pressure tool has pressure surfaces, which are parallel to each other. Pressurize the semi-round portion between the pressure surfaces in a direction perpendicular to the paper, and the assemblage is formed in fan shape as illustrated in FIG. 7(*c*). Apply more pressure, and the assemblage is formed in semi-circular shape as illustrated FIG. 7(*d*). Continue to pressurize one end 7*a* after removing the shaft hole-to-be portion 7*e* from the semi-circular portion, and the assemblage 7 is spread in a circumferential direction and shaped approximately round as illustrated in FIG. 7(*e*). Fix by welding or other means both open ends 7*f*, 7*f* of one end 7*a* thus shaped annular, and form an annular portion 7*c*.

As illustrated in FIG. 7(*f*), connect several approximately round assemblages 7 with a rod S inserted into the central hole 7*d* of the annular portion 7*c* of each assemblage and glue the annular portions 7*c* to each other. Then, pull the rod S out of the rotary brush comprising connected assemblages 7 and then make a drill tip go through the central hole 7*d* to form a smooth through hole. As illustrated in FIG. 7(*h*), cut to the same length other ends 7*b* of different lengths of the bristles 6 forming the outer periphery of the rotary brush.

The rotary brush 5 thus manufactured comprises the annular unit 5*a* having the round shaft hole 5*c* in the center thereof and the outer periphery 5*b* formed in approximately round-roll shape with many bristles 6 uniformly planted in the annular unit 5*a*. Affix the rotary brush 5 to the block handle 1, and the toothbrush is completed. In affixing it, insert the support shaft 4 to the shaft hole 5*c* of the rotary brush 5 and lean right and left extensions 2,3 outward and fit both ends 4*a*, 4*b* of the support shaft 4 to the fitting groove 2*b*, 3*b*. This enables the rotary brush 5 to be rotatably supported on the front end portion 1*b* of the block handle 1.

Figure 8:
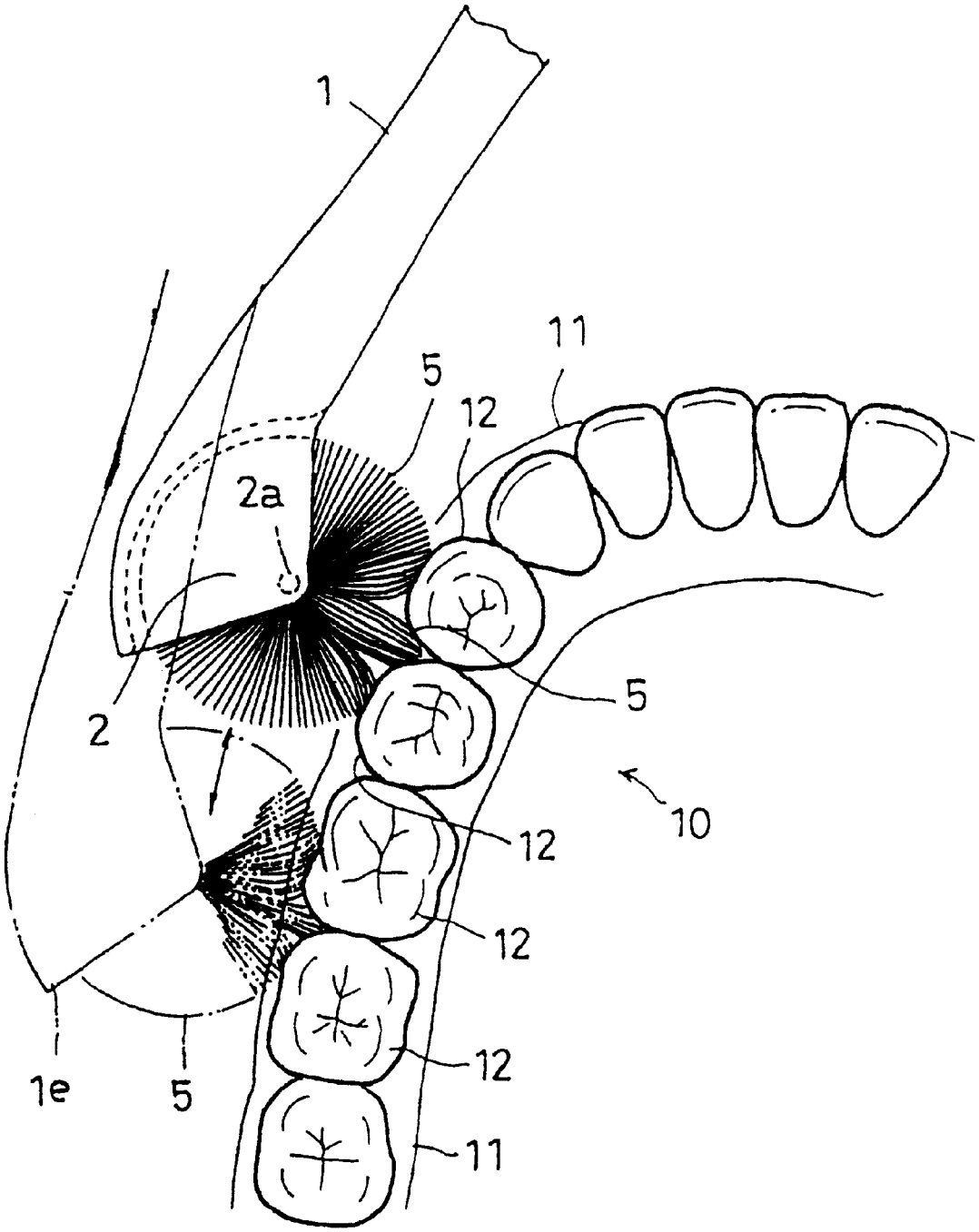
FIG. 8 is a view of toothbrushing by the present invention.

In using this toothbrush, grasp the grip portion 1*a* and put the rotary brush 5 into the oral cavity 10, and, as illustrated in FIG. 8, rotate it along teeth 12. Bristle tips forming the outer periphery 5*b* of the rotary brush 5 get in between teeth, and, as a result, it makes it possible to remove plaque or food particles and other detritus deposited on the peripheral surfaces of teeth 12 and their inner parts.

Rotating the rotary brush 5 on the gums 11 is effective to prevent or cure not only tooth decay but also pyorrhea alveolaris by massaging gums. Moreover, compared to popular toothbrushes, while brushing teeth, users don't have to move the block handle 1 back and forth strongly, and just grasp the block handle 1 lightly and rotate the rotary brush 5 softly. This feature reduces the burden of daily toothbrushing.

Another embodiment of the present toothbrush is described below. The basic constructions of the toothbrush in the following embodiments are almost the same as those of the above embodiment except for the configuration of the block handle.

Figure 9:
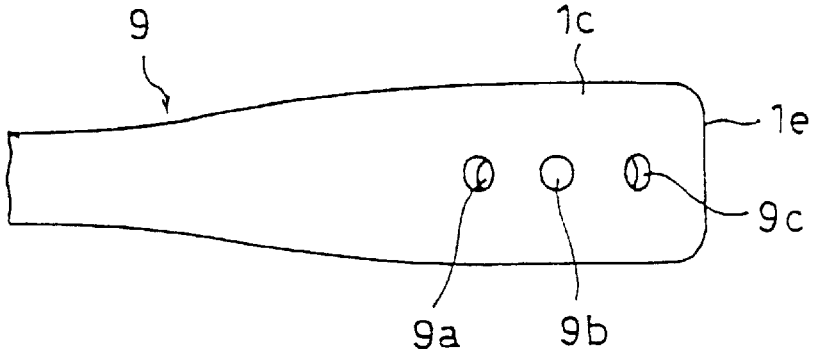
FIG. 9 is a in front view of a part of the handle of another embodiment of the invention.
Figure 10:
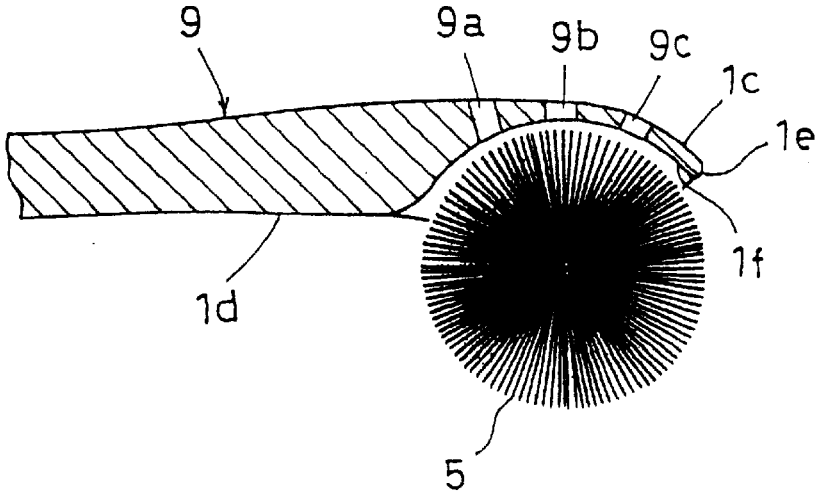
FIG. 10 is a sectional view of a part of the present toothbrush illustrated in FIG. 9.

As illustrated in FIGS. 9 and 10, this block handle 9 comprises three small holes 9*a*, 9*b*, 9*c* from the concave 1*f* where the rotary brush 5 is disposed, to the opposite upper surface 1*c*. This enables the air to blow into the mouth through the small through holes 9*a*, 9*b*, 9*c* and dry the inner parts of the oral cavity 10. Thus, users feel comfortable when brushing teeth.

In the above embodiments, the rotary brush 5 is supported by the support shaft 4 disposed between the right and left extensions 2, 3 which are formed in the front end portion of the block handle 1. It is also preferable to rotatably support the rotary brush 5 by an approximately L-shaped support shaft which is formed integrally with the front end portion 1*b* of the block handle 1. In this case, a stopper slightly bigger than the shaft hole 5*c* of the rotary brush 5 is disposed on the top end of the support shaft. In attaching the rotary brush 5, insert the shaft hole 5*c* of the rotary brush 5 to the shaft from the side of the stopper, and the rotary brush 5 is rotatably supported by the support shaft. In detaching the rotary brush 5, pull it strongly out of the stopper. This makes attachment and detachment easy. It is also easy to replace or clean the rotary brush 5.

As described in the foregoing, the present invention is a toothbrush comprising a rotary brush formed into a roller shape by binding many bristles and rotatably supported by a support shaft disposed in one end portion of a block handle. Grasp the other end of the block handle and then rotate the rotary brush along teeth and gums in the mouth, and bristle tips get in between teeth. This results in removing plaque deposited on teeth or food partials effectively and in massaging gums, which brings the effect of prevention or cure of tooth decay or periodontal diseases such as pyorrhea alveolaris.

What is claimed is:

1. A method for making a toothbrush comprising a rotary brush, and a handle, wherein the rotary brush is formed into a roller shape by extending many bristles radially outwardly from the outer peripheral surface of an annular unit provided with a shaft hole at the center thereof, and is supported by a support shaft disposed in one end portion of the said handle, having the steps of bundling many bristles made of nylon, heating and melting one end of a bundle of bristles into a deposited portion, curving the bundle of bristles into an approximately arc shape and connecting such arc shaped bundles.

2. A toothbrush having a rotary brush and a handle, the rotary brush being formed into a roller shape by the process comprising:

bundling many bristles made of nylon;

heating and melting one end of the bundle of bristles into a deposited portion;

curving the bundle of bristles into an approximately arc shape; and connecting such arc shaped bundles.

* * * * *